US008667652B2

(12) United States Patent
Thomas et al.

(10) Patent No.: US 8,667,652 B2
(45) Date of Patent: Mar. 11, 2014

(54) ZIP FASTENER

(75) Inventors: Steven Thomas, Cheshire (GB); Eiji Gonda, Cheshire (GB); Mike Wilson, Cheshire (GB)

(73) Assignee: YKK Corporation (JP)

( * ) Notice: Subject to any disclaimer, the term of this patent is extended or adjusted under 35 U.S.C. 154(b) by 0 days.

(21) Appl. No.: 12/835,344

(22) Filed: Jul. 13, 2010

(65) Prior Publication Data

US 2011/0005042 A1 Jan. 13, 2011

(30) Foreign Application Priority Data

Jul. 13, 2009 (GB) ..... 0912179.9

(51) Int. Cl.
*A44B 19/32* (2006.01)
*A44B 19/34* (2006.01)

(52) U.S. Cl.
USPC ..... 24/389; 24/397; 24/432

(58) Field of Classification Search
USPC ..... 24/432, 381, 398, 392, 434, 435, 389, 24/391, 395, 397, 413; 425/116; 29/408; 2/2.17; 190/119
IPC ..... A44B 19/32,19/34
See application file for complete search history.

(56) References Cited

U.S. PATENT DOCUMENTS

| | | | | |
|---|---|---|---|---|
| 2,288,105 | A * | 6/1942 | Plotkin | 190/119 |
| 2,385,816 | A * | 10/1945 | Krupp | 24/387 |
| 2,674,559 | A * | 4/1954 | Zobel | 156/66 |
| 3,143,778 | A * | 8/1964 | Abraham | 24/432 |
| 3,591,914 | A * | 7/1971 | Heimberger | 29/408 |
| 4,607,416 | A * | 8/1986 | Tanikawa et al. | 29/408 |
| 4,724,586 | A * | 2/1988 | Tsubokawa et al. | 24/389 |
| 5,386,616 | A * | 2/1995 | Norvell | 24/384 |
| 5,678,285 | A * | 10/1997 | Germani | 24/418 |
| 6,343,408 | B1 * | 2/2002 | Neugebauer | 24/389 |
| 6,519,826 | B1 | 2/2003 | Ortlieb | |
| 6,851,162 | B2 * | 2/2005 | Yuki et al. | 24/433 |
| 2002/0121005 | A1 | 9/2002 | Dawson | |
| 2008/0083098 | A1 * | 4/2008 | Cossutti et al. | 24/403 |
| 2008/0201918 | A1 * | 8/2008 | Takazawa et al. | 24/434 |

FOREIGN PATENT DOCUMENTS

| | | | |
|---|---|---|---|
| CN | 1272346 | A | 11/2000 |
| CN | 1112142 | C | 6/2003 |
| CN | 101238921 | A | 8/2008 |
| EP | 0108214 | | 5/1984 |
| EP | 1057423 | A1 | 6/2000 |
| EP | 1150586 | B1 | 4/2007 |
| WO | WO 2009/068848 | | 6/2009 |

OTHER PUBLICATIONS

Office Action, Chinese Patent Application No. 201010229687.8, mailed Sep. 22, 2011.

* cited by examiner

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A zip fastener including fabric tapes having coupling elements thereon is provided. A coating layer of thermoplastic material is provided on at least one first surface of the fastener tapes. The coating layer extends continuously along the first surface, extends over an edge of the fastener tapes and extends along at least one second surface of the fastener tapes.

11 Claims, 7 Drawing Sheets

ZIP FASTENER

This application claims priority to United Kingdom Patent Application No. 0912179.9 filed on Jul. 13, 2009, the disclosure, including specification, drawings and claims, of which is incorporated herein by reference in its entirety.

BACKGROUND

The present invention relates to a zip fastener, more particularly a coil type or metal type zip fastener and especially a substantially waterproof coil type or metal type zip fastener.

There are zip fasteners using a fastener tape which is usually woven or knitted and comprised for example of polyester. Fastener elements are attached to the fastener tape by for example crimping or moulding the fastener elements onto a reinforced edge of the fastener tape. Alternatively, when the fastener elements are comprised of a continuous coil, the fastener elements are most commonly woven or knitted into the tape or alternatively are stitched to the tape surface at the edge of the tape.

There also exists a requirement for zip fasteners which are waterproof, or more specifically, which allow a garment to be or remain waterproof once the zip fastener has been secured in place. For example, the rigorous requirements of outdoor pursuit garments often require the zip fasteners which are strong, hard wearing and impervious to fluids.

However, a problem exists when trying to attach a zip fastener to a fastener tape and still maintain a waterproof garment or article in that the usual attachment mechanism for the zip fastener to the tape, especially coil type fastener elements, traditionally involves stitching the coil fastener elements to the tape. As a result, needle holes are formed in the tape, which consequently impair the waterproof nature of the zip fastener.

Prior art teaching have sought to solve this problem and waterproof zip fasteners have been disclosed.

In WO2009/068848 (YKK), there is described a waterproof zip fastener which comprises a fabric tape having coupling elements disposed on an edge of the fabric tape and an extruded transparent thermoplastic material provided on a surface of the fabric tape. A pattern is printed on the tape surface and covered by the transparent layer. Whilst WO2009/068848 provides a waterproof zip fastener, both sides of the zip fastener are not sealed, and the edges of the tapes are not covered or sealed.

In EP 0108214, there is described a watertight slide fastener stringer which comprises a series of coupling elements mounted on a watertight stringer tape along a longitudinal edge thereof. Each coupling element includes a pair of upper and lower halves or members disposed one on each side of the stringer tape and joined by at least one integral connector extending through the stringer tape. The stringer tape is coated with an elastomer which joins to the connectors during an injection moulding process in order to prevent water leakage between opposing sides of the coupled fastener stringers.

Whilst in EP 0108214 both the front and back of the web core of the fastener tapes are covered with a resilient and water resistant elastomer, the tapes are covered with the water resistant elastomer prior to securing the coupling elements onto the fastener tapes. This procedure is not however practical when using a coil type fastener because the sewing procedure required to attach the coiled coupling elements to the tapes would damage the water resistant elastomer as a result of the needle holes created during sewing.

In U.S. Pat. No. 6,519,826 (Ortlieb), there is described a fluid tight zip fastener with a sealing port wherein the zip fastener is made of plastic in which spirals in the spiral zip fastener are injection moulded with a thermoplastic elastomer which forms a continuously contoured coating bearing directly on the contiguous edges of the zip fastener strips. When the zip fastener is closed, the coatings are under compression and form a contiguous seal with each other and the zip fastener slider to prevent fluid penetration.

Whilst U.S. Pat. No. 6,519,826 discloses a fluid tight zip fastener, the injection moulded coating which is used to create the fluid tight fastener is only located on one side of the slide fastener and does not extend over the entire width of the tapes, thereby providing the possibility for some ingress of fluid, especially if the injection moulded coating is pierced during the process of being attached to another article.

Furthermore, the bulky nature of the applied thermoplastic elastomer layer will not be suitable for many applications where an aesthetically pleasing and durable waterproof fastener is required.

SUMMARY

There therefore exists a requirement for a zip fastener, especially but not exclusively to coil type zip fasteners and metal type zip fasteners which can be suitably secured to a zip fastener tape so as to be capable of enduring for example extreme weather conditions and handling and which remains waterproof and impervious to fluids and where there is little interference with the coupling elements by the waterproofing facility.

Therefore, according to a first aspect of at least one embodiment of the present invention, there is provided, a zip fastener comprising fabric fastener tapes having coupling elements thereon, wherein a coating layer of a thermoplastics material is provided on at least one first surface of the fastener tapes, and wherein the coating layer extends continuously along the first surface, extends over an edge of the fastener tapes and also extends along at least one second surface of the fastener tapes. The zip fastener may be a coil zip fastener.

The zip fastener may further comprise a barrier region between the coating layers of thermoplastic material on the first and second surfaces of the fastener tapes.

The coating layer may not come into direct fixed contact with the fastening elements on either surface.

The coating layer may be extruded onto the tape surface of the fastener tapes and is preferably comprised of polyurethane. In addition, it may be required to have a pattern printed onto the tape surface underneath the coating layer using for example a thermochromic dye incorporated into the coating layer. Alternatively, a pearlescent material may be incorporated in the coating layer. Alternatively, the coating layer may be transparent or translucent.

The coating layer may form a waterproof layer on the coil zip fastener, the coating layer being provided on each of the fastener tapes and the coating layers abut against each other at a centre line of the zip fastener to form a seal.

The thickness of the coating layer on the first surface of the fastener tapes may be thicker than the thickness of the coating layer on the second surface of the fastener tapes.

The barrier region may further comprise a welding portion of the fabric tape and/or a body such as for example a thermoplastic material. The body may be adhered or woven to the fastener tapes.

The fabric fastener tapes may further comprise a hydrophobic treatment and/or may be comprised of hydrophobic material. The hydrophobic material may be hydrophobic yarn.

According to a second aspect of at least one embodiment of the present invention, there is provided a method of manufacturing the zip fastener according to the first aspect of at least one embodiment of the present invention, in which a fluid tight coating layer is provided on the fastener tapes, the method comprising the steps of: feeding the fastener tapes through an extrusion die; and extruding a coating layer of thermoplastic material onto the fastener tapes. When the coating layer is transparent, the fastener tapes may incorporate a pattern and the pattern may be printed onto the fastener tapes, for example by ink jet printing.

In addition, the zip fastener may comprise a waterproof polymer coating layer formed on the first and second surfaces of the fastener tapes, and may comprise a pattern embossed in either or both surfaces of the coating layer. In such cases, the polymer may be neoprene.

The method of manufacturing the zip fastener comprises the steps of feeding the fastener tapes through the extrusion die and extruding the waterproof polymer coating layer onto the surface of the fastener tapes to form a waterproof layer.

The present invention is applicable to a waterproof and even fluid impervious zip fastener but is not limited thereto.

The zip fastener according to the aspects of at least one embodiment of the present invention find particular application in waterproof garments and garments used for example in outdoor pursuits including for example walking clothes, diving suits etc. and also in waterproof articles for example tents and life-rafts, but is not limited thereto.

Other aspects and preferred features of the present invention will become apparent from the following description and the accompanying claims.

According to the aspects of at lease one embodiment of the present invention, there is provided a zip fastener which can be suitably secured to a zip fastener tape so as to be capable of enduring extreme whether conditions and handling while remaining waterproof and impervious to fluids where there is little interference with the coupling elements by the waterproofing facility.

DETAILED DESCRIPTION OF THE EMBODIMENTS

Figure 1A:
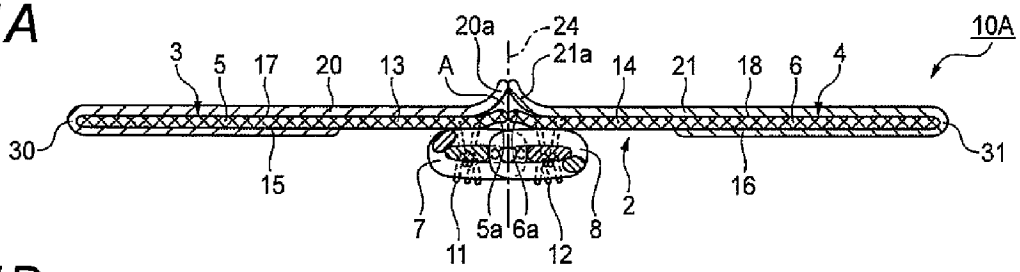
FIG. 1A—is a cross sectional view illustrating a zip fastener according to a first embodiment of the present invention.

Hereinafter, exemplary embodiments will be described with reference to the accompanying drawings.

In FIGS. 1A, 1B, 2A and 2B, there is illustrated a zip fastener 10A and a zip fastener 10B respectively of the general type described in EP-A-1150586, the entire contents of which are incorporated herein by reference.

The zip fastener 10A and 10B comprises a chain 2 formed from two stringers 3, 4. Each stringer 3, 4 comprises a fastener tape 5, 6 made from a woven or knitted fabric of for example polyester. A continuous coil comprising coupling elements 7, 8 is stitched to the edge 13, 14 of each fastener tape 5, 6 by sewing thread 11, 12 or woven into the edge 13, 14 of each fastener tape 5, 6, as well known and documented in the art. As seen in FIGS. 1A and 1B, 2A and 2B, the coupling elements 7, 8 are mounted on the underside (second surface) 15, 16 of each fastener tape 5, 6, respectively. The coupling elements 7, 8 provided in each fastener tape 5, 6 are comprised of a continuous coiled monofilament formed into a coiled shape or a zig-zag shape.

In addition, in accordance with the embodiments of the present invention, a coating layer 20, 21 of thermoplastic material is extruded onto the upper surface (first surface) 17, 18 of each fastener tape 5, 6 and extends around the outer edge of each fastener tape 5, 6 and along a portion of the underside (second surface) 15, 16 of each fastener tape 5, 6. The outer edge of each fastener tape 5, 6 are opposite to the inner edge 5*a*, 6*a* which will be described below in the width direction of each fastener tape 5, 6. The coating layer 20, 21 extend in the longitudinal direction and the width direction of each stringer 3, 4 on the first surface 17, 18, cover over the outer edge of each fastener tape 5, 6 and extend to the second surface 15, 16 with a gap between the coating layer 20, 21 and the coupling elements 7, 8. In the following description, a first surface side with respect to the fastener tape 5, 6 is referred to as an upper side and a second surface side with respect to the fastener tape 5, 6 is referred to as a lower side.

The coating layer 20, 21 may be transparent and may also be comprised of polyurethane. Whilst alternative thermoplastic material may be used, which includes for example, polyurethane, polypropylene and polyvinylchloride, as well as rubber, but not limited thereto, polyurethane is the preferred choice for the thermoplastic material. Thermoplastic elastomer is preferably used for the coating layer 20, 21. The coating layer 20, 21 is extruded onto the fastener tapes 5, 6 and bonds thereto during an extrusion process which will be described in further detail below.

Figure 1B:
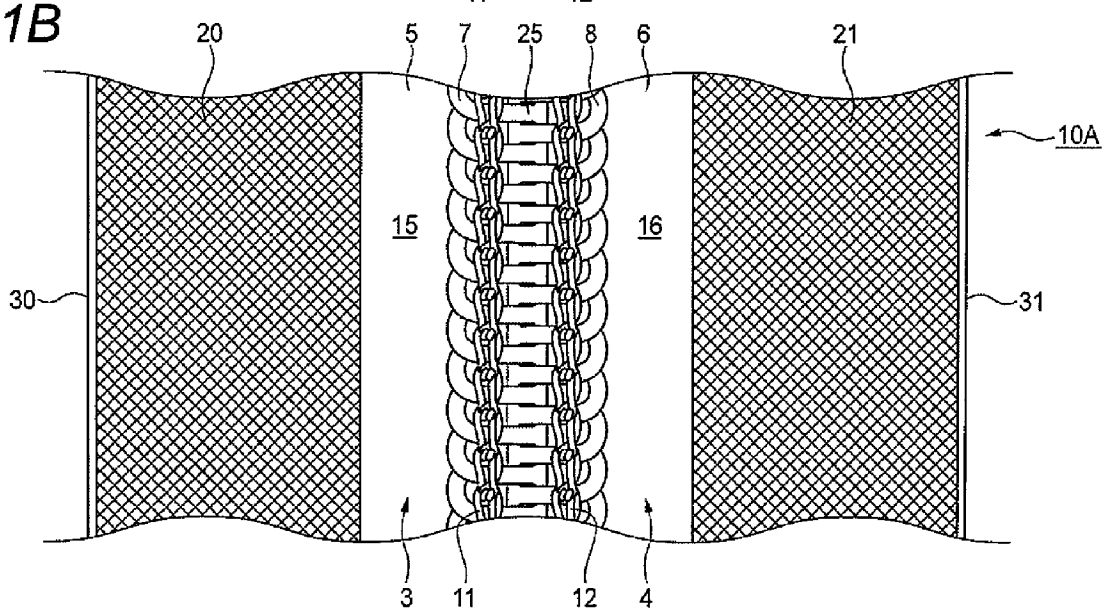
FIG. 1B—is a bottom plan view illustrating the zip fastener according to the first embodiment.

As seen in FIGS. 1A and 1B, the coating layer 20, 21 is formed such that the thickness of a part of the coating layer 20, 21, which is formed on the upper surface 17, 18 of each fastener tape 5, 6 is thicker than the thickness of a part of the coating layer 20, 21, which is formed on the lower surface 15, 16 of each fastener tape 5, 6. Here, the thickness is a dimension in a top and bottom direction of the fastener tapes 5, 6.

The finished product of the zip fastener 10A, 10B normally further comprises a slider (not shown) for opening and closing the chain 2 comprised of the coupling elements 7, 8. In addition, it is usual to have end stops located at either end of the zip fastener 10A, 10B to limit the movement of the slider along the zip fastener 10A, 10B. The Slider and the end stops are also well known in the art and will not be discussed in further detail here. The above-described width direction is a direction perpendicular to a direction (a longitudinal direction of the stringer) in which the slider moves along the coupling elements 7, 8.

A key feature of the zip fastener 10A, 10B according to the embodiments of the present invention is that the zip fastener 10A, 10B is impermeable to fluid, that is, it is gas impermeable and waterproof. In use, the coating layers 20, 21 of thermoplastic material form a fluid tight/waterproof membrane, and the coating layers 20, 21 on the first surfaces of the fastener tapes 5, 6 abut to each other at a centre line 24 which pass through the centre of the zip fastener 10A, 10B and is perpendicular to the plane of the fastener tapes 5, 6, thereby being sealed. The coating layer 20, 21 on the second surface does not come in direct contact with the coupling elements 7, 8 while forming a gap between the edge of the coating layer 20, 21 and the coupling elements 7, 8. Consequently, between the coating layer 20, 21 and the coupling elements 7, 8, a part of the second surface of the fastener tapes 5, 6 is exposed to the outside, as shown in FIG. 1B.

The zip fastener 10A, 10B according to the embodiments of the present invention is also applicable to other types of waterproof fasteners, such as described in EP-A-1057423, the contents of which are incorporated herein by reference, but is not limited to waterproof fasteners per se, of only to fasteners using continuous coil type coupling elements.

As described above, the preferred thermoplastic material for the coating layer 20, 21 is polyurethane. When the coating layer 20, 21 is transparent, it is possible to apply a printed pattern, which may take a variety of forms to the upper surfaces 20, 21 of the fastener tapes 5, 6. This pattern may be applied for example by ink jet printing and is printed to the fastener tapes 5, 6 prior to extrusion of the coating layer 20, 21 onto the tapes 5, 6. The printed pattern is a design on the first surfaces of the fastener tapes 5, 6 with two or more colors.

It is usual for the coating layers 20, 21 to be formed in the stringers 3, 4 when the stringers 3, 4 are separated. The coating layers 20, 21 form sealing lips 20*a*, 21*a* which extend laterally beyond the inner edges 5*a*, 6*a* of the fastener tapes 5, 6 and over the continuous coil fastener elements 7, 8. The inner edges 5*a*, 6*a* are opposed to each other. The lips 20*a*, 21*a* extend upwardly at an angle to the plane of the fastener tapes 5, 6 and abut to each other to form a raised area 'A' that is raised above the general plane of the stringers 3, 4, to form an inverted 'V' or triangular shape when the stringers 3, 4 are joined to each other by the slide fastener or slider. This raised region 'A' reduces the visibility of the join line 25 of the coiled elements 7, 8 when the fastener tapes 5, 6 are viewed from the upper side. The join line 25 is a portion which is visible from a gap between the inner edges 5*a*, 6*a* which are opposed to each other in a state where the coiled elements 7, 8 are engaged with each other.

As shown in FIGS. 1A, 1B and 2A, 2B, there is a region 30, 31 of the zip fastener 10A, 10B where the coating layer 20, 21 is extruded over the fastener tapes 5, 6. This region 30, 31 does not comprise any fastener tapes 5, 6. This region 30, 31 is compressable but less flexible than a part of the stringers 3, 4 which do comprise fastener tapes 5, 6. The significance of this region 30, 31 is that it is able to act as a guide if the slide fastener is sewn into another article and is disposed below material.

Figure 6:
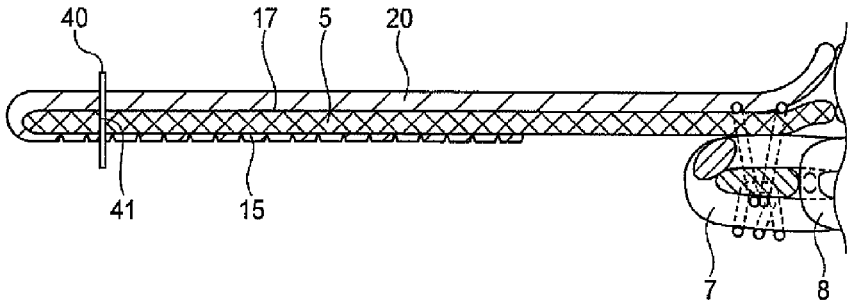
FIG. 6—is an enlarged cross sectional view illustrating the zip fastener attached to a garment.

A problem associated with the production of a fully fluid-proof fastener is that it is still necessary to secure the fastener to a garment or other article requiring fluid proof characteristics. The usual method by which the zip fastener is secured to the garment for example is the sewing with sewing thread 40 as seen in FIG. 6. Unfortunately, the sewing thread 40 causes holes 41 to be generated in the fastener tapes 5, 6 which may allow the ingress of water along the path created by the sewing threads 40.

Figure 7:
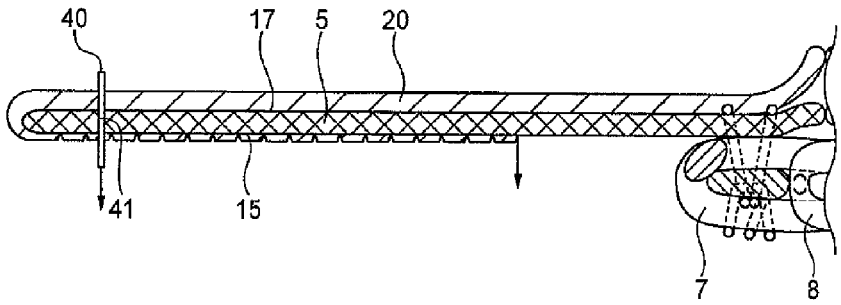
FIG. 7—is an enlarged cross sectional view illustrating the zip fastener attached to the garment for explaining ingress path of fluid due to a hole formed in a sewing process.
Figure 8:
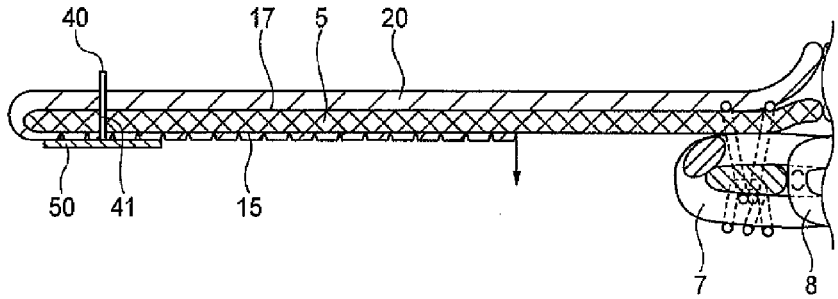
FIG. 8—is an enlarged cross sectional view illustrating the zip fastener attached to the garment where a waterproof backing material is applied to a sewing position at the underside of the fastener tape.

In order to avoid the holes formed in the sewing process from serving as a track (a path) for the ingress of fluid as seen in FIG. 7, a waterproof backing material 50, as shown in FIG. 8 may be applied to the underside of the fastener tapes 5, 6 or directly on the sewing thread 40. However in the embodiments of the present invention, after attachment of the zip fastener 10A, 10B to other articles (not shown), the zip fastener 10A, 10B may be ultrasonically welded in the region of the sewing threads 40 such that the lower layer of the coating layer 20, 21 and fastener tapes 5, 6 are secured together by the ultrasonic weld thereby forming an effective barrier to the tracking of water which may enter the zip fasteners 10A, 10B at the point of the sewing the fastener tapes 5, 6 to the garment etc. via holes 41. Further, as shown in FIG. 7, it is assumed that the ingress of water entered through the sewing threads 40 may occur from an end of the coating layer 20, 21 on the second surface.

Figure 2A:
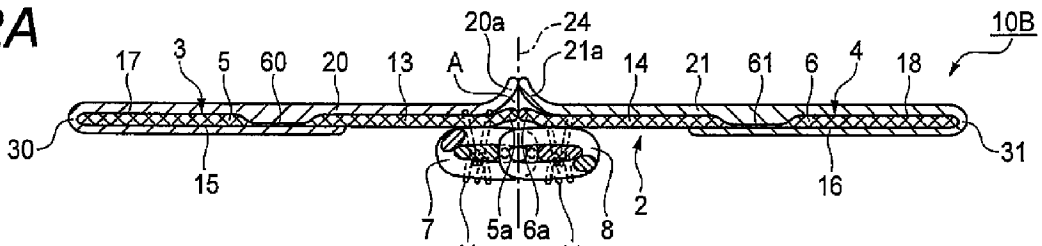
FIG. 2A—is a cross sectional view illustrating a zip fastener according to a second embodiment of the present invention.
Figure 2B:
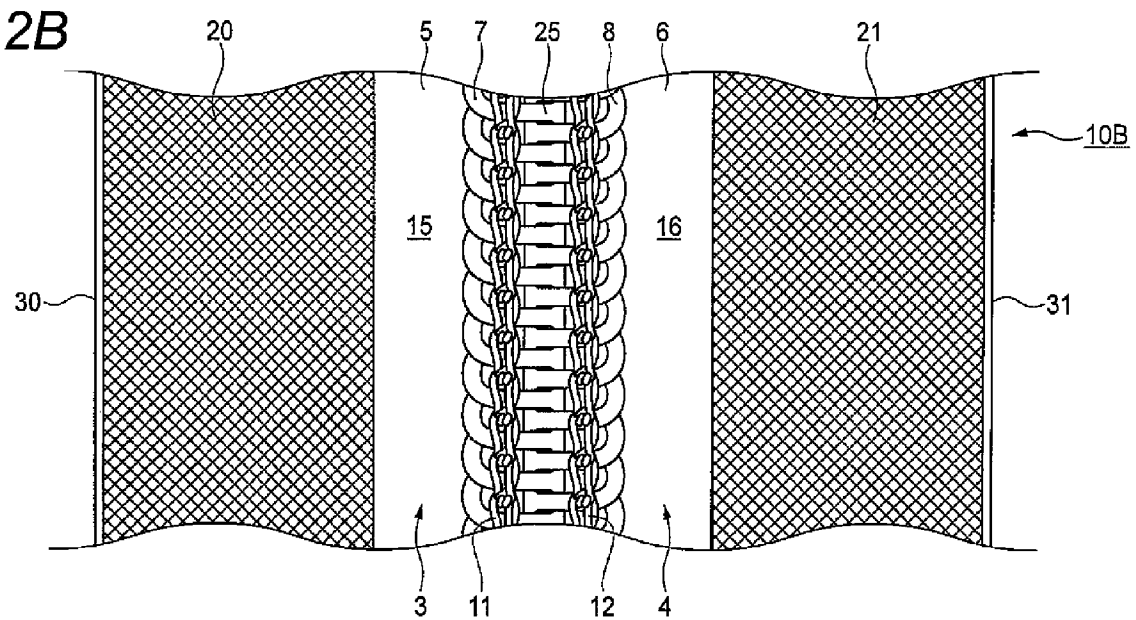
FIG. 2B—is a bottom plan view illustrating the zip fastener according to the second embodiment.

Furthermore, in the second embodiment shown in FIG. 2A, the zip fastener 10B can further comprise a well region 60, 61 on at least one of fastener tapes 5, 6. This well region 60, 61 comprises a barrier within the material of the fastener tapes 5, 6 and being in contact with the coating material 20, 21 on both the upper and lower surfaces of the fastener tapes 5, 6 to encase a part of the fastener tapes 5, 6 and so acts to prevent to the ingress of water beyond the encasement.

That is, the weld or welds within the fastener tapes 5, 6 between the lower side of the coating layer 20, 21 and the fastener tapes 5, 6 form a barrier. This enables the production of the zip fastener 10B which is substantially fluid-proof and is provided with a fluid impermeable upper layer of the coating layer 20, 21 and a barrier on the underside of the fastener against the ingress of fluid. Since the tissues of the fastener tapes 5, 6 are congested or integrated due to the welding, the barrier can prevent the ingress of water.

Whilst not wishing to be bound by any particular theory, the significance of the continuous extruded coating layer 20, 21 and the barrier is that the 'tracking' of fluid for example water along the woven threads of the fastener tapes 5, 6 is prevented.

The creating of a barrier can be obtained by the incorporation of a water resilient material within the fastener tapes 5, 6 by weaving such material into the fastener tapes 5, 6 or adhering it to the fastener tapes 5, 6. As shown in FIG. 11, the water resilient material 90 is incorporated within the fastener tape 5. The water resilient material 90 can prevent the ingress of water. A thread or a monofilament having water-repellent property and/or oil-repellent property may be used as the water resilient material 90. Alternatively, the material of the fastener tapes 5, 6 can be welded together into a unitary mass along the length of the fastener tapes 5, 6. The weld is preferably an ultrasonic weld. As shown in FIGS. 7 to 11, the coating materials 20, 21 on the second surface of the fastener tapes 5, 6 are formed with irregularity which is continued in the longitudinal direction of the stringer tape. The irregularity may be intermittently formed thereon. The irregularity may be formed on coating material 20, 21 on the first surface of the fastener tapes 5, 6 as well as the second surface of the fastener tapes 5, 6.

Figure 10:
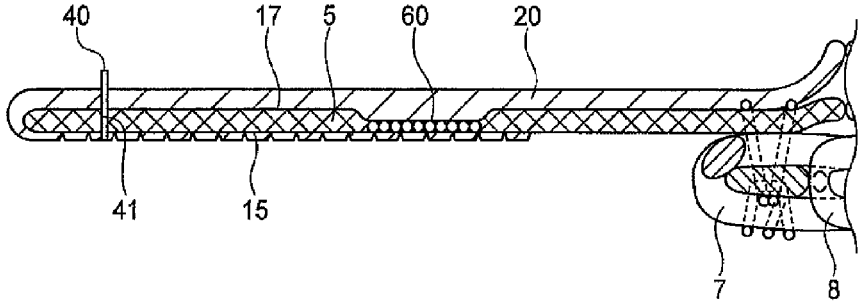
FIG. 10—is an enlarged cross sectional view illustrating the zip fastener where the fastener tape and the coating layer are ultrasonically welded to each other.
Figure 11:
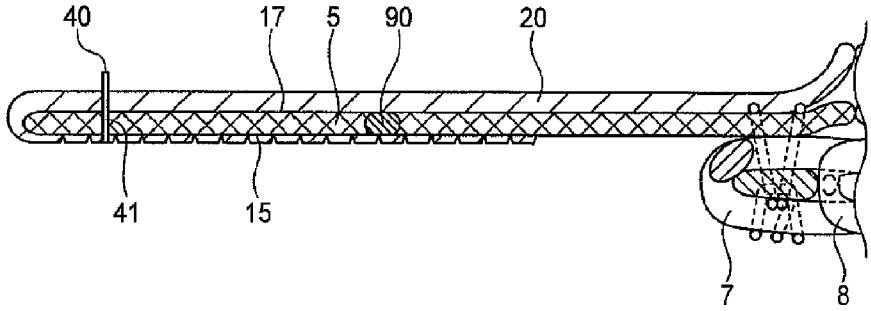
FIG. 11—is an enlarged cross sectional view illustrating the zip fastener where a barrier is formed without forming a well region.

The ultrasonic weld is preferably formed in area which is between the anticipated sewing line (sewing thread 40) and the coupling elements 7, 8 as shown in FIG. 10 and preferably may be formed prior to the processing of the zip fastener.

When the welding is performed after extruding the coating material 20, 21 onto the fastener tapes 5, 6, the coating material 20, 21 may also bond to the fastener tapes 5, 6 or otherwise interact with the fastener tapes 5, 6, contributing to the barrier.

The fastener tapes 5, 6 may be treated with a waterproofing or hydrophobic treatment prior to extrusion of the coating material 20, 21 and/or the yarn used to knit or weave the fastener tapes 5, 6 may be hydrophobic. As an example of the waterproofing or hydrophobic treatment, water repellent agent may be applied to the fastener tapes 5, 6 to prevent the ingress of water. Furthermore, as shown in FIG. 11, the barrier may be formed without forming the well region.

Figure 9:
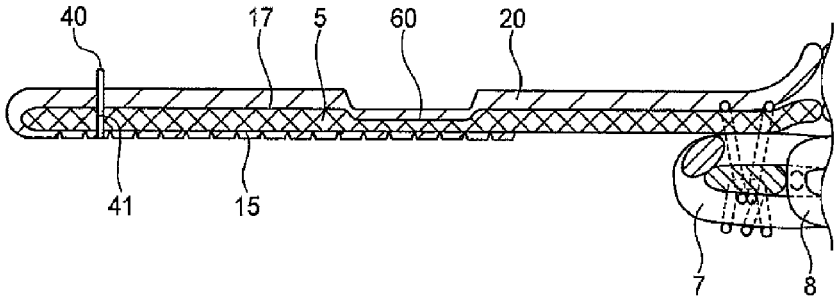
FIG. 9—is an enlarged cross sectional view illustrating the zip fastener where the fastener tape and a coating layer on the underside of the fastener tape are ultrasonically welded to each other to form a barrier.

A second aspect of the embodiments of the present invention relates to the manufacture of the zip fastener according to the first aspect of the embodiments of the present invention. In the manufacturing process, the fastener tape 5, 6 is fed through an extrusion die set under tension and thermoplastic coating layer 20, 21 is extruded under pressure onto a surface of the fastener tape 5, 6 to cause the coating layer 20, 21 to bond to the fastener tapes 5, 6. In the manufacture of the zip fastener according to the first aspect of the embodiments of the present invention, the coating layer 20, 21 extends on the fastener tape 5, 6, over one edge of the fastener tape 5, 6 and along the underside of the fastener tape 5, 6. In a preferred embodiment, the coating layer 20, 21 at the underside of the fastener tape 5, 6 is welded to the fastener tape 5, 6 for example by ultrasonic welding which will form a barrier to the ingress of water. In this case, the ultrasonic welding is performed after the extrusion of the coating layer 20, 21. In such a case, as shown in FIG. 9, a welded portion of the coating layer 20, 21 is thinner than both side portions of the coating layer 20, 21.

Alternatively, a weld portion may be formed from the zip fastener tape prior to the extrusion of the coating layer 20, 21 and thereby incorporating an additional hydrophobic material present in the tapes to form a barrier.

Figure 3:
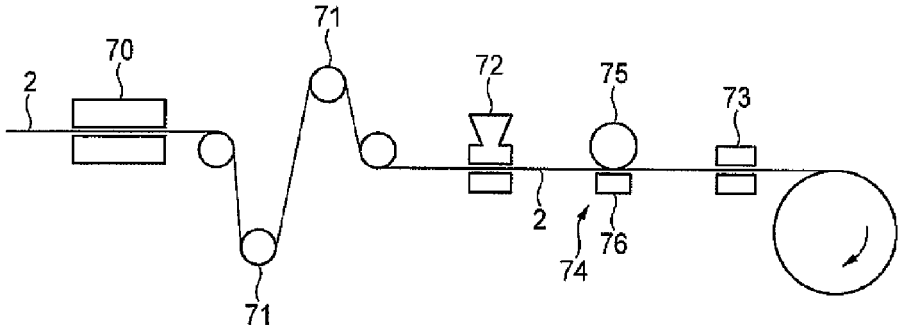
FIG. 3—is a schematic view illustrating an apparatus that performs a manufacturing process of the zip fastener according to the embodiments of the present invention.

Referring to FIG. 3 which relates to a further embodiment of the present invention, a fastener chain 2 comprising the fastener tapes 5, 6 and for example coupling elements 7, 8 may be fed through an ink jet printing machine 70, where a pattern is printed onto the upper surfaces 17, 18 of the fastener tapes 5, 6. After the ink is fixed, the chain 2 is drawn through an extrusion die set 72, tensioned by rollers 71 and the coating layer 20, 21 of for example, (transparent) polyurethane is extruded onto the upper surfaces 17, 18 of the fastener tapes 5, 6 over the printed pattern. Thereafter the stringer 3, 4 is fed to a slitting machine 73 where the coating layer 20, 21 is slit at the centre line 24. As described previously, the stringers 3, 4 may be fed through the production apparatus separately, or in parallel but separated from one another. The transparent coating layer 20, 21 is not limited to the colorless coating layer, but may be the colored coating layer through which the first surface or the second surface of the fastener tape 5, 6 can be seen.

Also shown in FIG. 3, is an embossing stage 74 for forming a three dimensional pattern or a relief on the upper surface of the coating layer 20, 21. The stage 74 comprises a pressure roller 75 having a textured surface, that comprises a three dimensional surface pattern which may be a regular pattern or random, and which is pressed against the upper surface of the coating layer 20, 21 when it exits from the extrusion die set 72, the chain 2 being supported from below by an anvil 76. The coating layer 20, 21 is still soft as it exits the extrusion die set 72 and so a pattern may be readily formed in the upper surface of the coating layer 20, 21. It is also possible to use this embossing stage 74 when neoprene or rubber coated fasteners are required and such materials are sued as the extruded layer. The fastener being fed through an extrusion die set 72 to form the neoprene layer and then the pressure roller 75 is used to apply an embossment to the surface of the neoprene layer at the downstream. When using thermoplastics layer, the embossing stage 74 may be performed at a later time, the thermoplastics layer being heated before embossing the pattern on the thermoplastics layer. The "neoprene" is a trade name and is commonly called chloroprene rubber.

Figure 4:
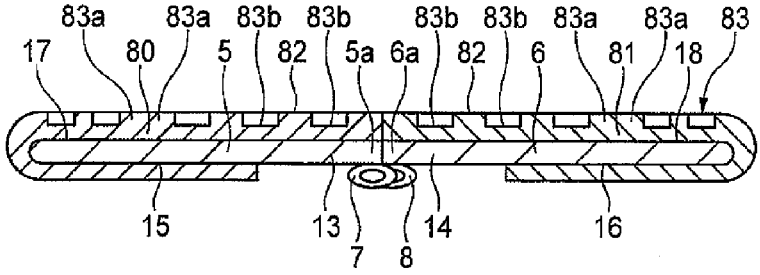
FIG. 4—is a cross sectional view illustrating a coil zip fastener according to a further embodiment of the present invention.
Figure 5:
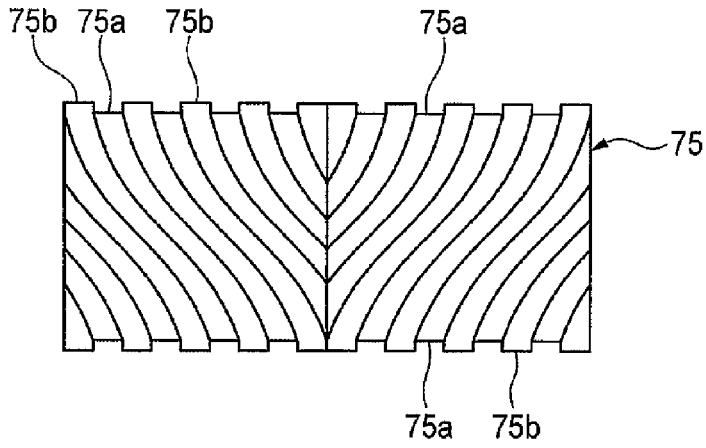
FIG. 5—is a front view illustrating a pressure roller of the apparatus shown in FIG. 3.

Referring to FIG. 4 showing another embodiment of the present invention, a coating layers 80, 81 comprised of neoprene which is waterproof polymer, are extruded onto the surface of the fastener tapes 5, 6. Thereafter, the surface of the coating layer 80, 81 is embossed, for example by passing the heated layer under a pressure roller 75 having a textured surface to form a three dimensional pattern 83 in the upper surface 82 of the coating layer 80, 81, such as described with reference to FIG. 3 above. The three dimensional pattern 83 consists of ridges 83*a* and grooves 83*b* running diagonally across the upper surface 82. These ridges 83*a* and grooves 83*b* can be formed by corresponding helical grooves 75*a* and ridges 75*b* formed on the pressure roller 75, as illustrated in FIG. 5. The embossment may be done at the point of extruding the neoprene layer onto the fastener tape 5, 6, while the layer is still soft, or sometime thereafter if a thermoplastics polymer which can be readily reheated and softened is used. By forming the three dimensional pattern 83 on the upper surface 82 of the coating layer 80, 81, the slipperiness of the layer is reduced, which will facilitate stitching or bonding the coated tape to a substrate as well as providing an attractive surface. As mentioned above, this embossment process is applicable to rubber or neoprene coatings as well as to the thermoplastic polymer coatings described above. A film material may be adhered to the fastener tapes 5, 6 to form the above described coating layer. The pattern formed by the embossment provides irregularity on the coating layer 20, 21 (80, 81) by the pressure roller 75 having an irregular (textured) surface. Here, the pattern includes a plurality of convexo-concaves. As an alternative to a pattern shown in FIG. 5, another irregular pattern can be formed by a pressure roller having dot-shaped irregular surface. If the coating layer 20, 21 (80, 81) is dyed with thermochromic material which varies its color at a predetermined temperature or is formed with a layer including pearlescent material, a zip fastener having pearly luster can be obtained. The above zip fastener is applicable to a garment, a tent, a rescue raft etc. and also applicable to the other articles.

The invention claimed is:

1. A zip fastener comprising fabric fastener tapes having coil type coupling elements thereon, wherein each fastener tape includes a coating layer of thermoplastic material on a first surface of the fastener tape, that extends continuously along the first surface, is folded back continuously at an edge of the fastener tape, and extends continuously along a portion of a second surface of the fastener tape, wherein the coating layers on the first surfaces of the fastener tapes abut against each other at a center line of the zip fastener to form a seal, wherein each fastener tape has a gap between the coating layer on the second surface and the coil type coupling elements attached to the second surface that exposes a portion of the second surface of the fastener tape, wherein a barrier is disposed within each fastener tape between the coating layer on the first surface of the fastener tape and the coating layer on the second surface of the fastener tape, wherein the coil type coupling elements are formed only on the second surface of each fastener tape, wherein each fastener tape is configured to be sewn with a sewing thread to secure the zip fastener to an article, and wherein the barrier is disposed at a side of the coil type coupling elements relative to the sewing thread.

2. The zip fastener according to claim 1, wherein the coating layer forms a waterproof layer.

3. The zip fastener according to claim 1, wherein a thickness of the coating layer on the first surface of the fastener tapes is thicker than the thickness of the coating layer on the second surface of the fastener tapes.

4. The zip fastener according to claim 1, wherein the coating layer does not come into direct contact with the coil type coupling elements of the zip fastener.

5. The zip fastener according to claim 1, wherein the fastener tapes further comprise a water resilient material.

6. The zip fastener according to claim 5, wherein the water resilient material is adhered or woven to the fastener tapes.

7. The zip fastener according to claim 1, wherein the barrier comprises a weld.

8. The zip fastener according to of claim 1, wherein the fastener tapes further comprise a hydrophobic treatment.

9. The zip fastener according to claim 1, wherein the fastener tapes are comprised of hydrophobic material.

10. The zip fastener according to claim 1, wherein the coating layer on the first surface extends beyond an inner edge of the fastener tapes.

11. A zip fastener comprising fabric fastener tapes having coil type coupling elements thereon, wherein a coating layer of thermoplastic material is provided on a first surface of each of the fastener tapes, wherein the coating layer extends continuously along the first surface, extends over an edge of the fastener tape, is folded back continuously at the edge of the fastener tape, and extends continuously along a second surface of the fastener tape, wherein the coating layers on the first surfaces of the fastener tapes abut against each other at a center line of the zip fastener to form a seal, wherein a width dimension of the coating layer on the second surface is less than a width dimension of the coating layer on the first surface, wherein the coil type coupling elements are formed only on the second surface of each fastener tape and do not come into direct contact with the coating layer, wherein a barrier is disposed within each fastener tape between the coating layer on the first surface of the fastener tape and the coating layer on the second surface of the fastener tape, wherein each fastener tape is configured to be sewn with a sewing thread to secure the zip fastener to an article, and wherein the barrier is disposed at a side of the coil type elements relative to the sewing thread.

* * * * *

UNITED STATES PATENT AND TRADEMARK OFFICE

CERTIFICATE OF CORRECTION

PATENT NO. : 8,667,652 B2
APPLICATION NO. : 12/835344
DATED : March 11, 2014
INVENTOR(S) : Steven Thomas et al.

It is certified that error appears in the above-identified patent and that said Letters Patent is hereby corrected as shown below:

In the Specification

In column 3, line 33, delete “lease” and insert -- least --, therefor.

In column 6, line 1, delete “compressable” and insert -- compressible --, therefor.

Signed and Sealed this
First Day of July, 2014

Michelle K. Lee

Michelle K. Lee
*Deputy Director of the United States Patent and Trademark Office*